US007260477B2

(12) United States Patent
Haugland

(10) Patent No.: US 7,260,477 B2
(45) Date of Patent: Aug. 21, 2007

(54) ESTIMATION OF BOREHOLE GEOMETRY PARAMETERS AND LATERAL TOOL DISPLACEMENTS

(75) Inventor: Samuel Mark Haugland, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 189 days.

(21) Appl. No.: 10/871,205

(22) Filed: Jun. 18, 2004

(65) Prior Publication Data

US 2005/0283315 A1 Dec. 22, 2005

(51) Int. Cl.
*G01V 1/40* (2006.01)
*E21B 47/022* (2006.01)

(52) U.S. Cl. ..... 702/6; 33/304

(58) Field of Classification Search ..... 702/6, 702/7–11; 33/304, 544; 367/35, 25, 33; 175/45

See application file for complete search history.

(56) References Cited

U.S. PATENT DOCUMENTS 4,817,059 A * 3/1989 Hornby et al. ..... 367/28
5,469,736 A 11/1995 Moake ..... 73/151
5,502,686 A * 3/1996 Dory et al. ..... 367/34
5,638,337 A * 6/1997 Priest ..... 367/27
5,737,277 A * 4/1998 Priest ..... 367/27
5,808,963 A * 9/1998 Esmersoy ..... 367/31
5,987,385 A * 11/1999 Varsamis et al. ..... 702/6
6,038,513 A * 3/2000 Varsamis et al. ..... 702/6
6,065,219 A * 5/2000 Murphey et al. ..... 33/544
6,078,867 A * 6/2000 Plumb et al. ..... 702/6
6,179,066 B1 * 1/2001 Nasr et al. ..... 175/45
6,725,162 B2 * 4/2004 Edwards et al. ..... 702/6
6,785,641 B1 * 8/2004 Huang ..... 703/7
6,891,777 B2 * 5/2005 Pabon et al. ..... 367/27

OTHER PUBLICATIONS

Birchak, J.R., Matthews, R. G., Moake, G.L. and Schultz, W.E., "Standoff and Caliper Measurements While Drilling Using a New Formation-Evaluation Tool with Three Ultrasonic Transducers", 68th Annual Technical Conference and Exhibition of the Society of Petroleum Engineers held in Houston Texas, Oct. 3-6, 1993, SPE 26494, pp. 793-806.

* cited by examiner

*Primary Examiner*—Donald E. McElheny, Jr.
*Assistant Examiner*—Toan M. Le

(57) ABSTRACT

A method for determining a borehole geometry parameter vector and/or lateral tool displacement vectors in a borehole is provided. The method includes acquiring at least one set of standoff measurements at a corresponding time. The method also includes processing a system of equations to determine the parameter vector and/or the lateral displacement vector(s). The system of equations may include variables representative of the parameter vector, the lateral tool displacement vector(s), and the standoff measurements. Exemplary embodiments of this invention advantageously enable the borehole parameter vector and/or the lateral displacement vector to be determined substantially contemporaneously.

31 Claims, 4 Drawing Sheets

ESTIMATION OF BOREHOLE GEOMETRY PARAMETERS AND LATERAL TOOL DISPLACEMENTS

FIELD OF THE INVENTION

The present invention relates generally to a method for logging a subterranean borehole. More specifically, this invention relates to processing standoff measurements to determine a borehole parameter vector (such as parameters determining the size and shape of the borehole) and lateral displacement vectors.

BACKGROUND OF THE INVENTION

Wireline and logging while drilling (LWD) tools are often used to measure physical properties of the formations through which a borehole traverses. Such logging techniques include, for example, natural gamma ray, spectral density, neutron density, inductive and galvanic resistivity, acoustic velocity, acoustic calliper, downhole pressure, and the like. Formations having recoverable hydrocarbons typically include certain well-known physical properties, for example, resistivity, porosity (density), and acoustic velocity values in a certain range. In many applications (particularly LWD applications) it is desirable to make azimuthally sensitive logging measurements, for example, to locate faults and dips that may occur in the various layers that make up the strata.

The shape of the borehole and the standoff distances between the various logging sensors and the borehole wall often influence such azimuthally sensitive logging measurements. Parameters that characterize the size and shape of a borehole are therefore of interest in many wireline and LWD applications. An instantaneous lateral displacement vector of a downhole tool within the borehole may also be of interest. Such lateral displacement vectors, in combination with tool azimuth measurements and the borehole parameters may be useful, for example, for imaging and azimuthal logging applications, such as LWD density imaging and azimuthal resistivity measurements. The above information may also be useful for interpreting and environmentally correcting azimuthally sensitive measurements such as multi-component resistivity, and directional acoustic measurements that may be used for analyzing anisotropic electrical and elastic properties of an earth formation.

Prior attempts have been documented to develop wireline and/or LWD tools and methods for estimating borehole geometry. Many such attempts make use of a plurality of acoustic standoff measurements. For example, Birchak (in Birchak et al., "Standoff and Caliper Measurements While Drilling Using a New Formation-Evaluation Tool with Three Ultrasonic Transducers", SPE 26494, 1993) describes a method in which a tool including three ultrasonic transducers is positioned in a borehole. The borehole is assumed to be circular and a borehole radius, an eccentering distance (the distance between the circular borehole and the center of the tool), and an azimuth are determined from the ultrasonic standoff measurements. While the Birchak method has been long used in commercial drilling operations, one drawback to that method is that the borehole shape is often not circular but rather elliptical (or some other shape). Therefore in many applications the Birchak method does not adequately represent the true borehole shape.

Priest, in U.S. Pat. No. 5,737,277, in attempting to overcome such limitations, discloses a method in which a preferably centralized tool including an acoustic transducer is rotated in a borehole. The shape of the borehole is assumed to be of quadratic form; thus the standoff measurements are fitted to an algebraic elliptical model to solve for the borehole parameters. Priest also assumes that the tool does not translate (i.e., move laterally) in the borehole during data acquisition. While this may be a suitable assumption in some wireline applications in which a centralized and/or stabilized tool is utilized, it typically leads to errors in LWD applications (in which the LWD tool along with the drill string are known to often undergo significant lateral movements in the borehole as drilling progresses). As such, the Priest method is not typically suitable for LWD applications.

Varsamis et al., in U.S. Pat. No. 6,038,513 disclose a method and apparatus for determining the ellipticity of a borehole. The method uses multiple circle-based calculations involving a statistical analysis of the standoff measurements made by three acoustic sensors in the borehole. The ellipticity (the ratio between the lengths of the major and minor axes of an ellipse) is then estimated based on the mean and standard deviation of the radius and an eccentering distance. While it may be suitable in some applications to estimate the ellipticity of the borehole, the Varsamis method does not provide for a determination of the length of the major and minor axes of the ellipse or the orientation of the ellipse. Nor does the Varsamis method provide for a determination of the tool position within the elliptical borehole.

Conventional wisdom in the industry and in the prior art suggests that at least five simultaneous transducer measurements are needed to determine the borehole parameters for an ellipse (major and minor axes and orientation) and a lateral displacement of the tool in an elliptical borehole. Even more transducer measurements would be required for boreholes having a more complex shape. The above cited prior art is representative of such conventional wisdom. In each case, for LWD applications, three standoff measurements are utilized in an attempt to determine three unknowns. Birchak assumes that the borehole is circular and attempts to determine the radius of the circle, the eccentering distance, and an azimuth. Varsamis also uses circle calculations and attempts to determine the radius of the circle and a lateral displacement of the tool in the borehole. In practice Varsamis is unable to unambiguously determine the lateral displacement of the tool, but rather determines it with a 180 degree ambiguity. Priest, on the other hand, assumes that the tool does not translate in the borehole and thus determines three different unknowns, the major axis, the minor axis, and the orientation of the assumed elliptical borehole. While it is theoretically possible, to utilize a measurement tool having five (or more) standoff sensors, such a tool would be considerably more complex than a conventional tool having three (or sometimes four) standoff sensors. Such complexity would increase fabrication and maintenance costs and likely reduce the reliability of the tool in demanding downhole environments. Furthermore, deploying five or more sensors about the circumference of a downhole tool may reduce the mechanical integrity of the tool body.

It will therefore be appreciated that there exists a need for improved methods for determining the shape of a borehole. In particular there is a need for a method for determining, substantially simultaneously, the borehole parameter vector of an elliptical borehole (or a borehole having a more complex shape) and an instantaneous lateral displacement vector between a measurement tool and the borehole.

SUMMARY OF THE INVENTION

The present invention addresses one or more of the above-described drawbacks of prior art techniques for determining the geometry of a borehole and/or lateral tool displacement within the borehole. Aspects of this invention include a method for determining a borehole parameter vector and/or an instantaneous lateral tool displacement vector for a downhole tool in a borehole. The method includes acquiring a plurality of standoff measurements and substituting them into a system of equations that may be solved for the borehole parameter vector and/or the lateral tool displacement vector. In one particular advantageous embodiment, the method includes acquiring a plurality of sets of standoff measurements (e.g., three) at a corresponding plurality of times, each set including multiple standoff measurements acquired via multiple standoff sensors (e.g., three). The standoff measurements may then be substituted into a system of equations that may be solved for both the borehole parameter vector (e.g., the major and minor axes and orientation of an ellipse) and an instantaneous lateral displacement vector at each of the plurality of times. The borehole parameter vector and the lateral tool displacement vector may then be associated with subterranean depth and utilized, for example, to correct azimuthally sensitive LWD data for local environments affecting such data.

Exemplary embodiments of the present invention may advantageously provide several technical advantages. For example, embodiments of this invention enable a parameter vector of a borehole having substantially any shape to be determined. Furthermore, the parameter vector may be determined without making any assumptions about the instantaneous lateral displacement of the measurement tool in the borehole. Rather, instantaneous lateral displacement vectors may be unambiguously determined substantially simultaneously with the borehole parameter vector. Moreover, exemplary method embodiments of this invention may be used with conventional ultrasonic standoff measurement tools (e.g., measurement tools including typically three ultrasonic standoff sensors deployed about the circumference of the tool).

In one aspect the present invention includes a method for determining a parameter vector of a borehole. The method includes providing a downhole measurement tool in the borehole (the tool including a plurality of standoff sensors deployed thereon), and causing the standoff sensors to acquire a plurality of sets of standoff measurements at a corresponding plurality of times. The method further includes processing a system of equations to determine the parameter vector of the borehole. The system of equations includes variables representative of the parameter vector of the borehole, the plurality of sets of standoff measurements, and an unknown lateral tool displacement vector in the borehole at each of the plurality of times. In one variation of this aspect, the tool further includes an azimuth sensor deployed thereon and the method further includes causing the azimuth sensor to acquire a plurality of azimuth measurements, each of the azimuth measurements acquired at one of the corresponding times and corresponding to one of the sets of standoff measurements.

In another aspect, this invention includes a method for determining a lateral displacement vector of a downhole tool in a borehole. The method includes providing the downhole tool in the borehole (the tool including a plurality of standoff sensors and an azimuth sensor deployed thereon), causing the standoff sensors to acquire a corresponding plurality of standoff measurements, and causing the azimuth sensor to acquire at least one azimuth measurement. The method further includes processing a system of equations to determine the lateral displacement vector for the downhole tool in the borehole, the system of equations including variables representative of the lateral displacement vector, the plurality of standoff measurements, and the at least one azimuth measurement. In one variation of this aspect, the system of equations further includes at least one variable representative of a known borehole parameter vector.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
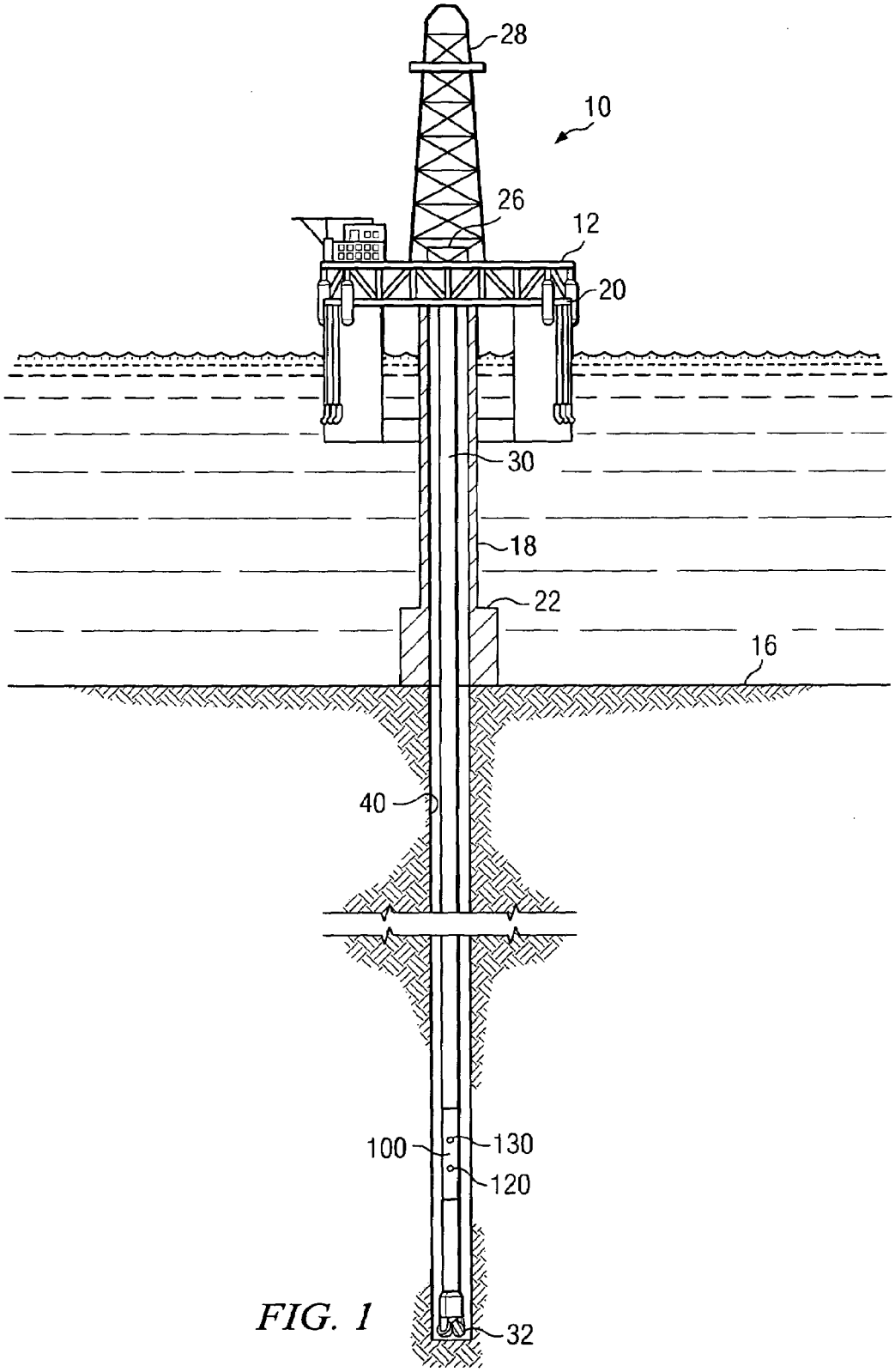
FIG. 1 is a schematic representation of an offshore oil and/or gas drilling platform utilizing an exemplary embodiment of the present invention.

FIG. 1 schematically illustrates one exemplary embodiment of a measurement tool 100 in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a measurement tool 100. Advantageous embodiments of measurement tool 100 typically include a plurality of standoff sensors 120 (one of which is shown in FIG. 1) and at least one azimuth sensor 130 deployed thereon. Standoff sensor 120 may include substantially any sensor suitable for measuring the standoff distance between the sensor and the borehole wall, such as, for example, an ultrasonic sensor. Azimuth sensor 130 may include substantially any sensor that is sensitive to its azimuth on the tool (e.g., relative to high side), such as one or more accelerometers and/or magnetometers. Drill string 30 may further include a downhole drill motor, a mud pulse telemetry system, and one or more other sensors, such as a nuclear logging instrument, for sensing downhole characteristics of the borehole and the surrounding formation.

It will be understood by those of ordinary skill in the art that the deployment illustrated on FIG. 1 is merely exemplary for purposes of describing the invention set forth herein. It will be further understood that the measurement tool 100 of the present invention is not limited to use with a semisubmersible platform 12 as illustrated on FIG. 1. Measurement tool 100 is equally well suited for use with any kind of subterranean drilling operation, either offshore or onshore.

Figure 2:
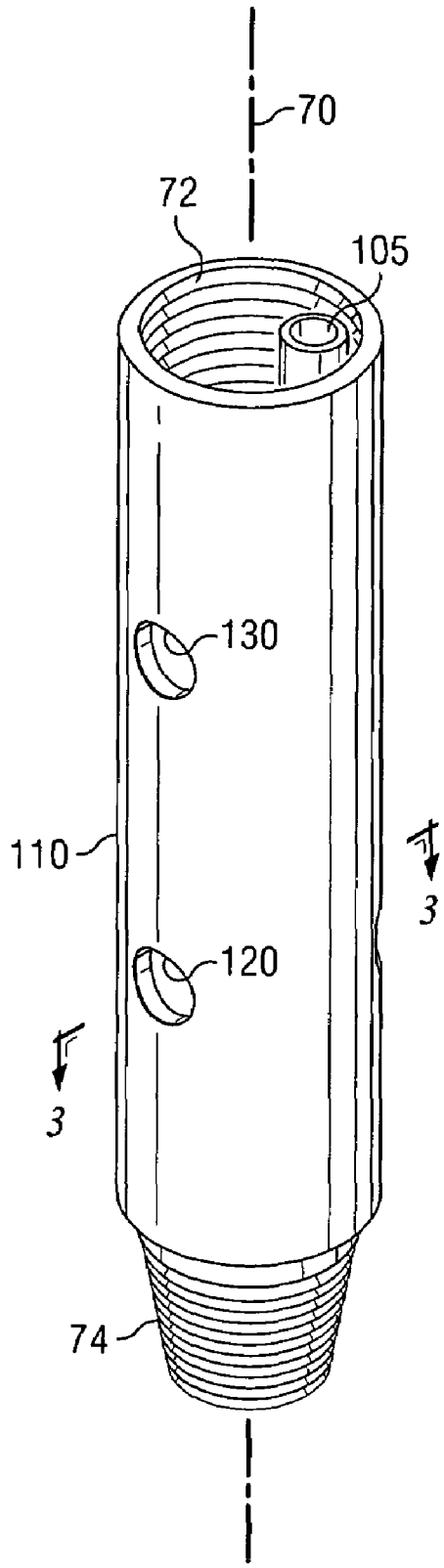
FIG. 2 depicts one exemplary measurement tool suitable for use with exemplary methods of this invention.

Referring now to FIG. 2, one exemplary embodiment of a measurement tool 100 from FIG. 1 is illustrated in perspective view. Measurement tool 100 may typically be a substantially cylindrical tool, being largely symmetrical about longitudinal axis 70. In the exemplary embodiment shown, standoff sensors 120 and azimuth sensor 130 are deployed in a substantially cylindrical tool collar 110. The tool collar may be configured for coupling to a drill string (e.g., drill string 30 on FIG. 1) and therefore typically, but not necessarily, includes threaded pin 74 and box 72 ends for coupling to the drill string. Through pipe 105 provides a conduit for the flow of drilling fluid downhole, for example, to a drill bit assembly (e.g., drill bit 32 on FIG. 1).

Figure 3:
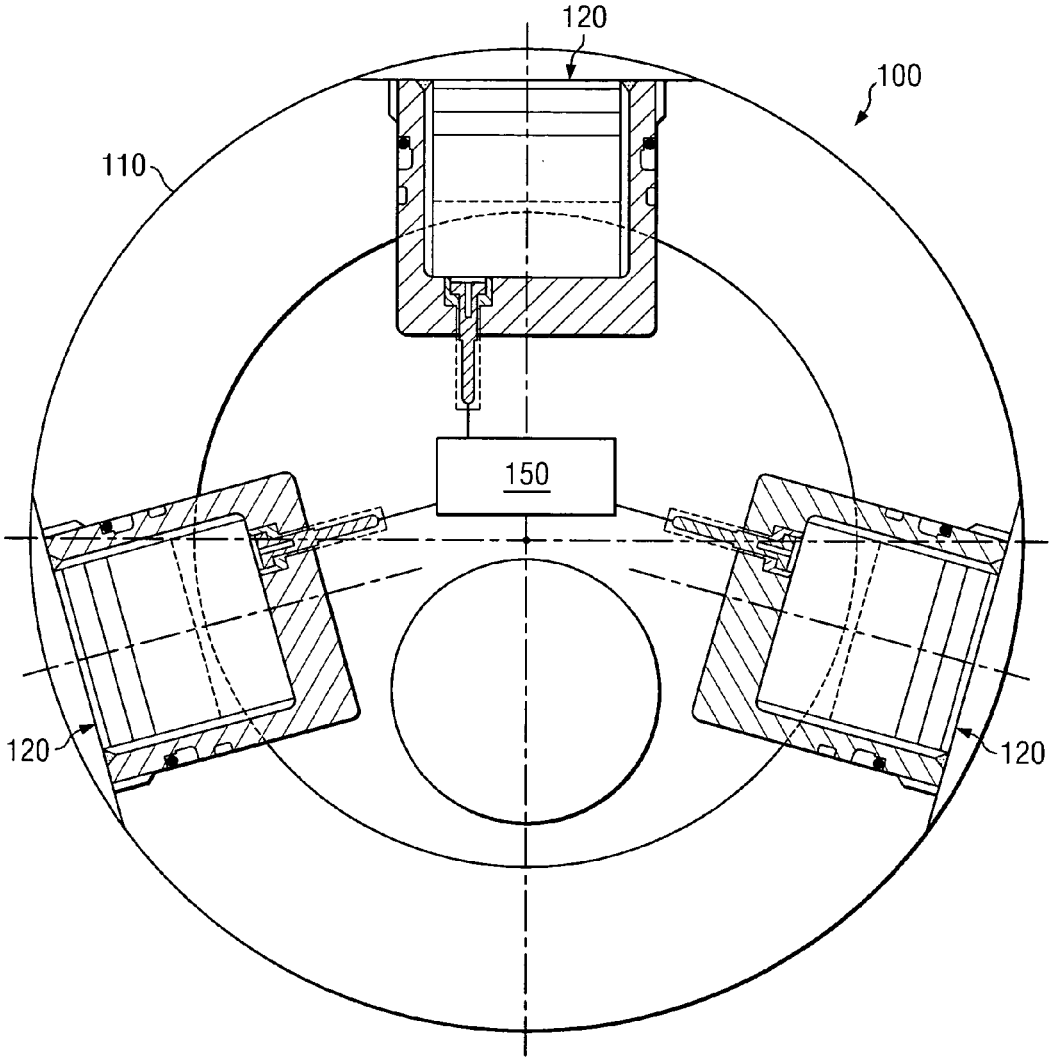
FIG. 3 is a cross sectional view as shown on FIG. 2.

With reference now to FIG. 3, the illustrated exemplary embodiment of measurement tool 100 includes three standoff sensors 120 deployed about the circumference of the drill collar 110. It will be appreciated that this invention is not limited to any particular number or circumferential position of the standoff sensors 120. Suitable standoff sensors 120 include, for example, conventional ultrasonic sensors. Such ultrasonic sensors may operate, for example, in a pulse-echo mode in which the sensor is utilized to both send and receive a pressure pulse in the drilling fluid (also referred to herein as drilling mud). In use, an electrical drive voltage (e.g., a square wave pulse) may be applied to the transducer, which vibrates the surface thereof and launches a pressure pulse into the drilling fluid. A portion of the ultrasonic energy is typically reflected at the drilling fluid/borehole wall interface back to the transducer, which induces an electrical response therein. Various characteristics of the borehole, such as the standoff distance between the sensor and the borehole wall may be determined utilizing such ultrasonic measurements.

With continued reference to FIG. 3, the standoff sensors 120 are typically coupled to a controller, which is illustrated schematically at 150. Controller 150 includes, for example, conventional electrical drive voltage electronics (e.g., a high voltage, high frequency power supply) for applying a waveform (e.g., a square wave voltage pulse) to a transducer, causing the transducer to vibrate and thus launch a pressure pulse into the drilling fluid. Controller 150 may also include receiving electronics, such as a variable gain amplifier for amplifying the relatively weak return signal (as compared to the transmitted signal). The receiving electronics may also include various filters (e.g., low and/or high pass filters), rectifiers, multiplexers, and other circuit components for processing the return signal.

A suitable controller 150 might further include a programmable processor (not shown), such as a microprocessor or a microcontroller, and may also include processor-readable or computer-readable program code embodying logic, including instructions for controlling the function of the standoff 120 and azimuth 130 (FIGS. 1 and 2) sensors. A suitable processor may be further utilized, for example, to estimate borehole parameters and lateral tool displacements in the borehole (as described in more detail below) based on standoff and azimuth sensor measurements. Such information may be useful for imaging and other azimuthally sensitive applications and may therefore be utilized to estimate physical properties (e.g., resistivity, dielectric constant, acoustic velocity, density, etc.) of the surrounding formation and/or the materials comprising the strata.

With continued reference to FIG. 3, a suitable controller 150 may also optionally include other controllable components, such as sensors, data storage devices, power supplies, timers, and the like. The controller 150 may also be disposed to be in electronic communication with various sensors and/or probes for monitoring physical parameters of the borehole, such as a gamma ray sensor, a depth detection sensor, or an accelerometer, gyro or magnetometer to detect azimuth and inclination. Controller 150 may also optionally communicate with other instruments in the drill string, such as telemetry systems that communicate with the surface. Controller 150 may further optionally include volatile or non-volatile memory or a data storage device. The artisan of ordinary skill will readily recognize that while controller 150 is shown disposed in collar 110, it may alternatively be disposed elsewhere, either within the measurement tool 100 or at another suitable location.

In the embodiments shown in FIGS. 1 through 3, azimuth sensor 130 is longitudinally spaced and deployed at substantially the same azimuthal (circumferential) position on the tool 100 as one of the standoff sensors 120. It will be appreciated that this invention is not limited to any particular layout (positioning) of the standoff sensors 120 and the azimuth sensor(s) 130 on the tool 100. For example, in an alternative embodiment (not shown) the standoff sensors 120 and the azimuth sensor 130 may be deployed at substantially the same longitudinal position. It will also be appreciated that this invention is not limited to any particular number of standoff and/or azimuth sensors. Moreover, as described in more detail below, certain exemplary methods of this invention do not rely on azimuth measurements and hence do not require a downhole tool having an azimuth sensor.

Figure 4:
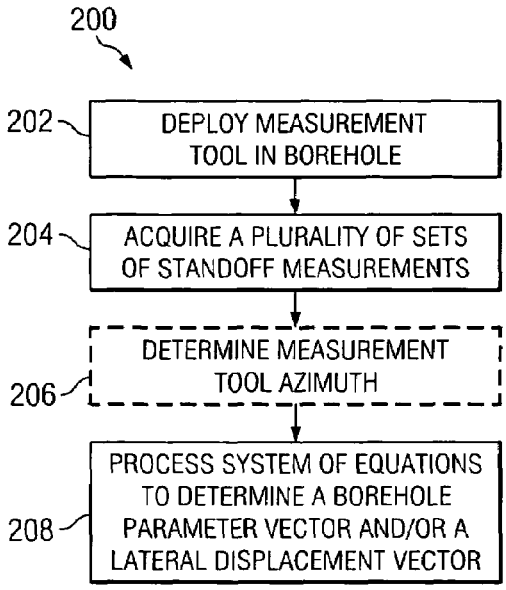
FIG. 4 depicts a flowchart of one exemplary method embodiment of this invention.

Referring now to FIG. 4, a flowchart of one exemplary embodiment of a method 200 according to this invention is illustrated. A measurement tool is deployed in a borehole at 202 (e.g., measurement tool 100 is rotated with drill string 30 in borehole 42 as shown on FIG. 1). At 204, a plurality of sets of standoff measurements are acquired at a corresponding plurality of instants in time, each set of standoff measurements including a standoff measurement acquired at each of a plurality of standoff sensors (e.g., three as described above with respect to FIG. 3). For example, in one exemplary embodiment, a first set of standoff measurements may be acquired at a first time, a second set of standoff measurements may be acquired at a second time, and a third set of standoff measurements may be acquired at a third time. Returning to FIG. 4, the tool azimuth may be optionally determined for each set of standoff measurements at 206 such that each set is assigned an azimuth. The standoff measurements and optional tool azimuths may then be substituted into a system of equations, which are solved at 208 for a previously unknown borehole parameter vector and/or a previously unknown lateral tool displacement vector. The results may then be typically transmitted to the surface and/or stored in memory. It will be appreciated that, as described in more detail below, the parameter vector may be determined without making any assumptions about the instantaneous lateral displacement of the measurement tool in the borehole. Rather, instantaneous lateral displacement vectors may be determined simultaneously with the borehole parameter vector.

Borehole Parameter Vector Determination

Figure 5:
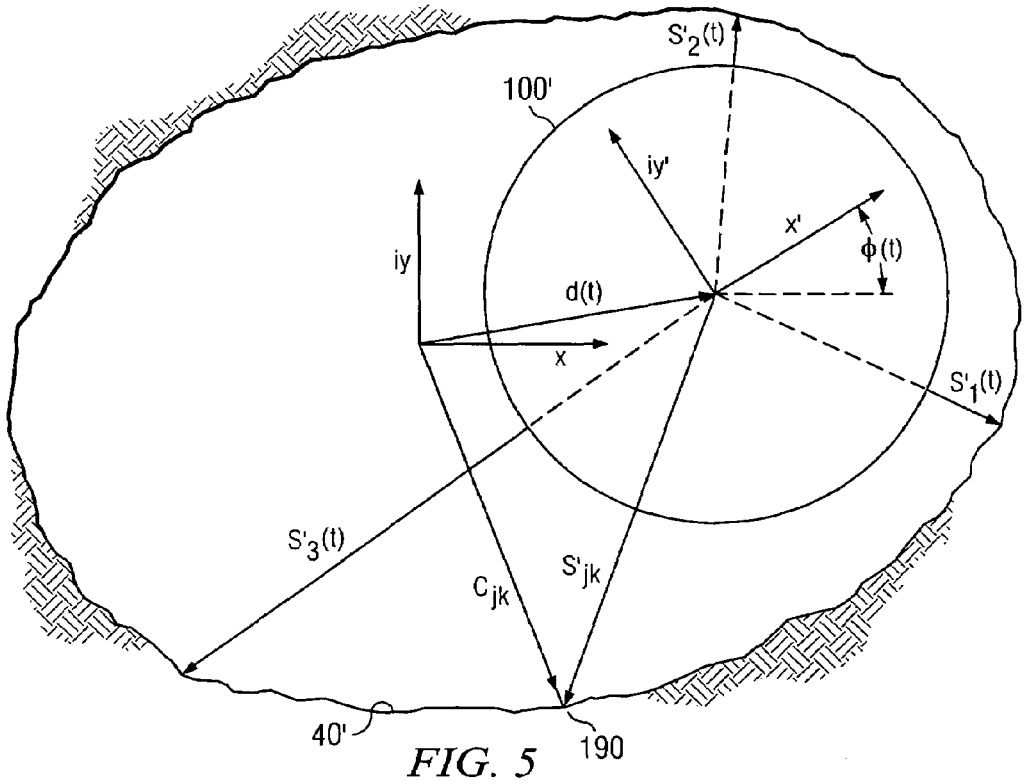
FIG. 5 depicts, in schematic form, a cross section of an exemplary measurement tool suitable for use with exemplary methods of this invention deployed in an exemplary borehole.

With reference now to FIG. 5, a schematic of a cross section of a downhole measurement tool 100' deployed in a borehole 40' is shown (e.g., measurement tool 100 shown deployed in borehole 40 on FIG. 1). The measurement tool 100' includes a plurality of standoff sensors (not shown on FIG. 5) deployed thereon (e.g., as described above with respect to FIGS. 1 through 3). In the embodiment shown, borehole 40' is represented as having an elliptical cross section, however it will be appreciated that substantially any borehole shape may be evaluated. For mathematical convenience, borehole and tool coordinate systems are taken to be complex planes in which various vectors therein may be represented as complex numbers. The borehole and tool coordinate systems may be represented mathematically as follows:

$$w=x+iy \qquad \text{Equation 1}$$

$$w'=x'+iy' \qquad \text{Equation 2}$$

where w and w' represent the reference planes of the borehole and measurement tool, respectively, x and y represent Cartesian coordinates of the borehole reference plane, x' and y' represent Cartesian coordinates of the measurement tool 100' reference plane, and i represents a square root of the integer −1. At any instant in time, t, the coordinates of a vector in one coordinate system (e.g., the tool coordinate system) may be transformed to the other coordinate system (e.g., the borehole coordinate system) as follows:

$$w=w'\exp(i\phi(t))+d(t) \qquad \text{Equation 3}$$

where d(t) represents an unknown, instantaneous lateral displacement vector between the borehole and tool coordinate systems, and where $\phi(t)$ represents an instantaneous tool azimuth. As shown in Equation 3, the lateral displacement vector is a vector quantity that defines a magnitude and a direction between the tool and borehole coordinate systems in a plane substantially perpendicular to the longitudinal axis of the borehole. For example, in one embodiment, the lateral displacement vector may be defined as the magnitude and direction between the center point of the tool and the center point of the borehole in the plane perpendicular to the longitudinal axis of the borehole. As described in more detail herein, $\phi(t)$ may be measured in certain embodiments of this invention (e.g., using one or more azimuth sensors deployed on the measurement tool 100'). In certain other embodiments of this invention, $\phi(t)$ may be treated as an unknown with its instantaneous values being determined from the standoff measurements. The invention is not limited in this regard.

With continued reference to FIG. 5, $s'_j(t)$, where $j=1, \ldots, n$ represent instantaneous standoff vectors from the n standoff sensors mounted on the measurement tool 100'. As described above with respect to FIGS. 1 through 3, certain advantageous embodiments of measurement tool 100' include n=3 standoff sensors, however, the invention is not limited in this regard. The tool 100' may include substantially any number of standoff sensors. For example, as described in more detail below, certain other embodiments of measurement tool 100' may advantageously include n=4 standoff sensors.

With further reference to FIG. 5, borehole 40' may be represented mathematically by a simple closed curve as follows:

$$c(\bar{p},\tau)=u(\bar{p},\tau)+iv(\bar{p},\tau) \qquad \text{Equation 4}$$

where u and v define the general functional form of the borehole (e.g., circular, elliptical, etc.), $\tau$ represents the angular position around the borehole such that: $0\leqq\tau<1$, and $\bar{p}$ represents the borehole parameter vector, $\bar{p}=[p_1, \ldots, p_q]^T$, including the q unknown borehole parameters that define the shape and orientation of the borehole cross section. For example, an elliptical borehole includes a parameter vector having three unknown borehole parameters (the major and minor axes of the ellipse and the angular orientation of the ellipse). It will be appreciated that exemplary embodiments of this invention enable borehole parameter vectors having substantially any number, q, of unknown borehole parameters to be determined.

With continued reference to FIG. 5, sets of standoff measurements may be acquired at substantially any number of instants in time, each set including a standoff measurement acquired from each standoff sensor. Such standoff measurements may be represented as $s'_{jk}=s'_j(t_k)$ for times $t=t^k$, where $k=1, \ldots, m$. Azimuth measurements may also be acquired at substantially the same instants in time as the sets of standoff measurements and may be represented as $\phi_k=\phi(t_k)$. Since $s'_{jk}$ and $c_{jk}=c(\bar{p},\tau_j(t_k))$ terminate at the same point on the borehole wall (point 190 on FIG. 5), $s'_{jk}$ and $c_{jk}$ may be substituted into Equation 3, which yields the following system of coupled nonlinear equations:

$$d_k+s'_{jk}\exp(i\phi_k)-c_{jk}=0 \qquad \text{Equation 5}$$

where, as described above, $d_k$ represent the lateral displacement vectors between the borehole and tool coordinate systems at each instant in time k, $\phi_k$ represent the tool azimuths at each instant in time k, and $s'_{jk}$ and $c_{jk}$ represent the standoff vectors and borehole vectors, respectively, for each standoff sensor j at each instant in time k. It will be appreciated that Equation 5 represents a system of n times m complex-valued, nonlinear equations (or 2 mn real-valued nonlinear equations) where n represents the number of standoff sensors (such that $j=1, \ldots, n$), and m represents the number of sets of standoff measurements (such that $k=1, \ldots, m$). It will also be appreciated that for embodiments in which $\phi_k$ is known (e.g., measured via an azimuth sensor), Equation 5 includes m(n+2)+q unknowns where q represents the number of unknown borehole parameters.

Equations 5 may be solved for the unknown parameter vector $\bar{p}$, the lateral displacement vectors $d_k$, and the auxiliary variables $\tau_{jk}=\tau_j(t_k)$ (where $\tau_{jk}$ represents the angular position of each standoff sensor j at each instant in time k), provided that the number of independent real-valued equations in Equation 5 is greater than or equal to the number of unknowns. As described above, at each instant in time k at which a set of n standoff measurements is acquired, 2n (real-valued) equations result. However, only n+2 unknowns are introduced at each instant in time k (n auxiliary variables plus the two unknowns that define the lateral displacement vector). Consequently, it is possible to accumulate more equations than unknowns provided that 2n>n+2 (i.e., for embodiments including three or more standoff sensors). For example, an embodiment including three standoff sensors accumulates one more equation than unknown at each instant in time k. Thus for an embodiment including three standoff sensors, as long as $m\geqq q$ (i.e., the number of sets of standoff measurements is greater than or equal to the number of unknown borehole parameters) it is possible to solve for the parameter vector of a borehole having substantially any shape.

In one exemplary serviceable embodiment of this invention, a measurement tool including three ultrasonic standoff sensors deployed about the circumference of the tool rotates in a borehole with the drill string. The standoff sensors may be configured, for example, to acquire a set of substantially simultaneous standoff measurements over an interval of about 10 milliseconds. The duration of each sampling interval is preferably substantially less than the period of the tool rotation in the borehole (e.g., the sampling interval may be about 10 milliseconds, as stated above, while the rotational period of the tool may be about 0.5 seconds). Meanwhile, the azimuth sensor measures the azimuth of the tool, and correspondingly each of the standoff sensors, as the tool rotates in the borehole. An azimuth is then assigned to each set of standoff measurements. The azimuth is preferably measured at each interval, or often enough so that the azimuth of the tool may be determined for each set of standoff measurements, although the invention is not limited in this regard.

Upon acquiring the ultrasonic standoff measurements, the unknown borehole parameter vector and the lateral tool displacements may be determined as described above. For example, in this exemplary embodiment, it may be assumed that the borehole is substantially elliptical in cross section (e.g., as shown on FIG. 5). An elliptical borehole may be represented mathematically by a simple closed curve as follows:

$$c(\bar{p},\tau)=(a\cos(2\pi\tau)+ib\sin(2\pi\tau))\exp(i\Omega) \qquad \text{Equation 6}$$

where $0\leqq\tau<1$, $a>b$, and $0\leqq\Omega<\pi$. The parameter vector for such an ellipse may be defined as $\bar{p}=[a, b, \Omega]^T$ where a, b, and $\Omega$ represent the q=3 unknown borehole parameters of the elliptical borehole, the major and minor axes and the angular orientation of the ellipse, respectively. Such borehole parameters may be determined by making m=3 standoff measurements using a measurement tool including n=3 ultrasonic standoff sensors (e.g., as shown on FIG. 3), which yields the following system of equations:

$$d_1+s'_{11}\exp(i\phi_1)-c_{11}=0$$

$$d_1+s'_{12}\exp(i\phi_1)-c_{12}=0$$

$$d_1+s'_{13}\exp(i\phi_1)-c_{13}=0$$

$$d_2+s'_{21}\exp(i\phi_2)-c_{21}=0$$

$$d_2+s'_{22}\exp(i\phi_2)-c_{22}=0$$

$$d_2+s'_{23}\exp(i\phi_2)-c_{23}=0$$

$$d_3+s'_{31}\exp(i\phi_3)-c_{31}=0$$

$$d_3+s'_{32}\exp(i\phi_3)-c_{32}=0$$

$$d_3+s'_{33}\exp(i\phi_3)-c_{33}=0 \qquad \text{Equation 7}$$

where d, s', $\phi$, and c are as defined above with respect to Equation 5. Substituting Equation 6 into Equation 7 yields the following:

$$d_1+s'_{11}\exp(i\phi_1)=(a\cos(2\pi\tau_{11})+ib\sin(2\pi\tau_{11}))\exp(i\Omega)$$

$$d_1+s'_{12}\exp(i\phi_1)=(a\cos(2\pi\tau_{12})+ib\sin(2\pi\tau_{12}))\exp(i\Omega)$$

$$d_1+s'_{13}\exp(i\phi_1)=(a\cos(2\pi\tau_{13})+ib\sin(2\pi\tau_{13}))\exp(i\Omega)$$

$$d_2+s'_{21}\exp(i\phi_2)=(a\cos(2\pi\tau_{21})+ib\sin(2\pi\tau_{21}))\exp(i\Omega)$$

$$d_2+s'_{22}\exp(i\phi_2)=(a\cos(2\pi\tau_{22})+ib\sin(2\pi\tau_{22}))\exp(i\Omega)$$

$$d_2+s'_{23}\exp(i\phi_2)=(a\cos(2\pi\tau_{23})+ib\sin(2\pi\tau_{23}))\exp(i\Omega)$$

$$d_3+s'_{31}\exp(i\phi_3)=(a\cos(2\pi\tau_{31})+ib\sin(2\pi\tau_{31}))\exp(i\Omega)$$

$$d_3+s'_{32}\exp(i\phi_3)=(a\cos(2\pi\tau_{32})+ib\sin(2\pi\tau_{32}))\exp(i\Omega)$$

$$d_3+s'_{33}\exp(i\phi_3)=(a\cos(2\pi\tau_{33})+ib\sin(2\pi\tau_{33}))\exp(i\Omega) \qquad \text{Equation 8}$$

As described above with respect to Equation 5, Equation 8 includes 18 real-valued equations (2 mn) and 18 unknowns (m(n+2)+q). Equation 8 may thus be solved simultaneously for the parameter vector $\bar{p}=[a,b,\Omega]^T$ and the unknown lateral displacements $d_1$, $d_2$, and $d_3$ (each of which includes a real and an imaginary component and thus constitutes two unknowns). It will be appreciated that Equation 8 may be solved (with the parameter vector and lateral displacements being determined) using substantially any known suitable mathematical techniques. For example, Equation 8 may be solved using the nonlinear least squares technique. Such numerical algorithms are available, for example, via commercial software such as Mathematica® (Wolfram Research, Inc., Champaign, Ill.). Nonlinear least squares techniques typically detect degeneracies in the system of equations by detecting degeneracies in the Jacobian matrix of the transformation. If degeneracies are detected in solving Equation 8, the system of equations may be augmented, for example, via standoff measurements collected at additional instants of time until no further degeneracies are detected. Such additional standoff measurements effectively allow the system of equations to be over-determined and therefore more easily solved (e.g., including 24 equations and 23 unknowns when four sets of standoff measurements are utilized or 30 equations and 28 unknowns when five sets of standoff measurements are utilized).

It will, of course, be appreciated that techniques for solving the above described systems of non-linear equations (such as the above described nonlinear least squares technique) typically require an initial estimate to be made of the solutions to the system of nonlinear equations. The need for such an initial estimate will be readily apparent to those of ordinary skill in the art. Methodologies for determining and implementing such initial estimates are also well understood by those of ordinary skill in the art.

Lateral Tool Displacement Vector Determination

In typical drilling applications, the rate of penetration of the drill bit (typically in the range of from about 1 to about 100 feet per hour) is often slow compared to the angular velocity of the drill string and the exemplary measurement intervals described above. Thus in typically LWD applications it is not always necessary to continuously determine the borehole parameter vector. Rather, in some applications, it may be preferable to determine the borehole parameter vector at longer time intervals (e.g., at about 60 second intervals, which represents about a twelve-inch depth interval at a drilling rate of 60 feet per hour). At intermediate times, the borehole parameter vector may be assumed to remain substantially unchanged and the standoff measurements, azimuth measurements, and the previously determined borehole parameter vector, may be utilized to determine the lateral displacement of the tool in the borehole. For example, as shown in Equation 9 for a hypothetical elliptical borehole, the lateral displacement vector may be unambiguously determined in substantially real time via a single set of standoff sensor measurements:

$$d_1+s'_{11}\exp(i\phi_1)=(a\cos(2\pi\tau_{11})+ib\sin(2\pi\tau_{11}))\exp(i\Omega)$$

$$d_1+s'_{12}\exp(i\phi_1)=(a\cos(2\pi\tau_{12})+ib\sin(2\pi\tau_{12}))\exp(i\Omega)$$

$$d_1+s'_{13}\exp(i\phi_1)=(a\cos(2\pi\tau_{13})+ib\sin(2\pi\tau_{13}))\exp(i\Omega) \qquad \text{Equation 9}$$

where a, b, and Ω represent the previously determined borehole parameters and $d_1$ represents the lateral displacement vector. It will be appreciated that Equation 9 includes 5 unknowns (the $d_1$ vector and $\tau_{11}$,$\tau_{12}$, and $\tau_{13}$) and 6 real valued equations, and thus may be readily solved for $d_1$ as described above. It will also be appreciated that only two standoff measurements are required to unambiguously determine $d_1$ and that a system of equations including 4 unknowns and 4 real valued equations may also be utilized.

If the measurement tool is determined to be at a substantially constant lateral position (e.g., lying against the low side of the borehole) over some time interval, it may be advantageous in certain applications (such as applications in which processor availability it limited) to utilize known prior art techniques to determine the borehole parameters. One such technique, for example, assumes that the lateral tool position is a constant and that the borehole has an elliptical cross section. In such applications, exemplary embodiments of this invention may be utilized as a quality control check on such prior art methods, for example, to determine when and if the assumptions of the prior art are valid (e.g., the assumption that the lateral tool position is constant with time).

It will be appreciated that this invention is not limited to the assumption that the m standoff sensors substantially simultaneously acquire standoff measurements as in the example described above. In a typical acoustic standoff sensor arrangement, it is typically less complex to fire the transducers sequentially, rather than simultaneously, to save power and minimize acoustic interference in the borehole. For example, in one exemplary embodiment, the individual transducers may be triggered sequentially at intervals of about 2.5 milliseconds. In such embodiments, it may be useful to account for any change in azimuth that may occur during such an interval. For example, at an exemplary tool rotation rate of 2 full rotations per second, the tool rotates about 2 degrees per 2.5 milliseconds. In such embodiments, it may be useful to measure the tool azimuth for each stand off sensor measurement. The system of complex, nonlinear equations shown above in Equation 5 may then alternatively be expressed as:

$$d_k+s'_{jk}\exp(i\phi_{jk})-c_{jk}=0 \qquad \text{Equation 10}$$

where $d_k$, $s'_{jk}$, and $c_{jk}$ are as defined above with respect to Equation 5, and $\phi_{jk}$ represents the tool azimuth at each standoff sensor at each instant in time. Equation 10 may then be solved, for example, as described above with respect to Equations 5 through 8 to determine the borehole parameter vector and the lateral tool displacements. It will be appreciated that this invention is not limited to any particular time intervals or measurement frequency.

Use of N=4 Standoff Sensors

For certain applications, an alternative embodiment of the measurement tool including n=4 standoff sensors may be advantageously utilized. In such an alternative embodiment, the standoff sensors may be deployed, for example, at 90 degree intervals around the circumference of the measurement tool. Such an embodiment may improve tool reliability, since situations may arise during operations in which redundancy is advantageous to obtain three reliable standoff measurements at some instant in time. For example, the measurement tool may include a sensor temporarily in a failed state, or at a particular instant in time a sensor may be positioned too far from the borehole wall to give a reliable signal. Moreover, embodiments including n=4 standoff sensors enable two more equations than unknowns to be accumulated at each instant in time k. Thus for an embodiment including four standoff sensors, as long as $m \geqq q/2$ (i.e., the number of sequential measurements is greater than or equal to one half the number of unknown borehole parameters) it is possible to solve for the parameter vector of a borehole having substantially any shape. For example, only two sequential standoff measurements are required to determine the parameter vector of an elliptical borehole. Alternatively, three sequential standoff measurements may be utilized to provide an over-determined system of complex, nonlinear equations, which may be more easily solved using conventional nonlinear least squares techniques.

One other advantage to utilizing a measurement tool having n=4 standoff sensors is that the azimuth of the measurement tool does not need to be measured. It will be appreciated that in embodiments in which the tool azimuth $\phi_k$ is unknown, Equation 5 includes m(n+3)+q unknowns. Consequently, in such embodiments, it is possible to accumulate more equations than unknowns provided that 2n>n+3 (i.e., for embodiments including four or more standoff sensors). Thus for an embodiment including n=4 standoff sensors, as long as $m \geqq q$ (i.e., the number of sequential measurements is greater than or equal to the number of unknown borehole parameters) it is possible to solve for the parameter vector of a borehole having substantially any shape as well as the measurement tool azimuth and lateral displacement vector at each interval.

Although particular embodiments including n=3 and n=4 standoff sensors are described above, it will be appreciated that this invention is not limited to any particular number of standoff sensors. It will also be appreciated that there is a tradeoff with increasing the number of standoff sensors. While increasing the number of standoff sensors may provide some advantages, such as those described above for embodiments including n=4 standoff sensors, such advantages may be offset by the increased tool complexity, which tends to increase both fabrication and maintenance costs, and may also reduce tool reliability in demanding downhole environments.

It will also be appreciated that embodiments of this invention may be utilized in combination with substantially any other known methods for correlating the above described time dependent sensor data with depth values of a borehole. For example, the borehole parameter vectors determined in Equations 5 through 8 and 10 may be tagged with a depth value using known techniques used to tag other LWD data. The borehole parameters may then be plotted as a function of depth as with other types of LWD data.

It will be understood that the aspects and features of the present invention may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

I claim:

1. A method for determining a parameter vector of a borehole, the method comprising:

(a) providing a downhole measurement tool in the borehole, the tool including a plurality of standoff sensors deployed thereon;

(b) causing the standoff sensors to acquire a plurality of sets of standoff measurements at a corresponding plurality of times;

(c) proccssing a system of equations to calcuate both the parameter vector of the borehole and an azimuth of at least one of the standoff sensors at each of the plurality of times, the system of equations including variables representative of (i) (he parameter vector of the borehole, (ii) the plurality of sets of standoff measurements, (iii) an unknown lateral tool displacement vector in the borehole at each of the plurality of times, and (iv) the unknown azimuth at each of the plurality of times; and (d) performing at least one step selected from the group consisting of: (i) storing the parameter vector to downhole or surface memory, (ii) transmitting the parameter vector to the surface, and (iii) displaying the parameter vector to an operator.

2. The method of claim 1, wherein (a) further comprises rotating the measurement tool in the borehole about a longitudinal axis.

3. The method of claim 1, wherein the tool includes at least three standoff sensors.

4. The method of claim 1, wherein the plurality of standoff sensors includes at least one acoustic standoff sensor.

5. The method of claim 1, wherein each of the plurality of standoff sensors are deployed at substantially the same longitudinal position on the tool.

6. The method of claim 1 wherein (b) comprises causing the plurality of standoff sensors to acquire at least three sets of standoff measurements at at least three corresponding times.

7. The method of claim 1, wherein the standoff sensors acquire standoff measurements sequentially.

8. The method of claim 1, wherein the tool further comprises a controller, the controller being disposed to cause the standoff sensor to acquire the plurality of sets of standoff measurements in (b), the controller further disposed to determine the parameter vector for the borehole in (c).

9. The method of claim 1, wherein (c) further comprises processing the system of equations to determine the unknown lateral tool displacement vectors at each of the plurality of times.

10. The method of claim 1, wherein the system of equations in (c) comprises:

$$d_k+s'_{jk}\exp(i\phi_k)-c_{jk}=0$$

wherein i represents a square root of the integer −1; $d_k$ represent lateral displacement vectors between a borehole coordinate system and a tool coordinate system at each of the times k; $\phi_k$ represent the unknown azimuths at each of the times k; and $s'_{jk}$ and $c_{jk}$ represent standoff vectors and borehole vectors, respectively, for each of the standoff sensors j at each of the times k.

11. The method of claim 1, wherein the borehole is assumed in (c) to be elliptical in shape and the system of equations in (c) comprises:

$$d_k+s'_{jk}\exp(i\phi_k)=(a\cos(2\pi\tau_{jk})+ib\sin(2\pi\tau_{jk})\exp(i\Omega)$$

wherein i represents a square root of the integer −1; $d_k$ represent lateral displacement vectors between a borehole coordinate system and a tool coordinate system at each of the times k; $\phi_k$ represent the unknown azimuths at each of the times k; $s'_{jk}$ represent standoff vectors for each of the standoff sensors j at each of the times k; a and b represent major and minor axes of said elliptical borehole; Ω represents an angular orientation of said elliptical borehole; and $\tau_{jk}$ represent auxiliary variables.

12. The method of claim 1, wherein (c) comprises processing the system of equations according to a nonlinear least squares technique to determine the parameter vector of the borehole.

13. The method of claim 1, further comprising:

(d) causing the tool to acquire an additional set of standoff measurements at another time; and (e) augmenting the system of equations to include variables representative of the additional set of standoff measurements acquired in (d).

14. The method of claim 1, wherein the tool is coupled to a drill string.

15. The method of claim 1, wherein the tool further comprises a logging while drilling tool.

16. A method for determining a lateral displacement vector of a downhole tool in a borehole, the method comprising:

(a) providing the tool in the borehole, the tool including a plurality of standoff sensors and an azimuth sensor deployed thereon;

(b) causing the plurality of standoff sensors to acquire a plurality of standoff measurements;

(c) causing the azimuth sensor to acquire at least one azimuth measurement;

(d) processing a system of equations to determine the lateral displacement vector of the tool in the borehole, the system of equations being selected from the group consisting of:

$$d_k+s'_{jk}\exp(i\phi_k)-c_{jk}=0;\text{ and}$$

$$d_k+s'_{jk}\exp(i\phi_k)=(a\cos(2\pi\tau_{jk})+ib\sin(2\pi\tau_{jk})\exp(i\Omega)$$

wherein i represents a square root of the integer −1; $d_k$ represent laternal displacement vectors at each of the times k; $\phi_k$ represent azimuth measurements at each of the times k; and $s'_{jk}$ and $c_{jk}$ represent standoff vectors and borehole vectors, respectively, for each of the standoff sensors j at each of the times k, a and b represent major and minor axes of said elliptical borehole; Ω represents an angular orientation of said elliptical borehole; and $\tau_{jk}$ represent auxiliary variables; and (e) performing at least one step selected from the group consisting of: (i) storing the lateral displacement vector to downhole or surface memory, (ii) transmitting the lateral displacement vector to the surface, and (iii) displaying the lateral displacement vector to an operator.

17. The method of claim 16, wherein:

(b) comprises causing the plurality of standoff sensors to acquire a plurality of sets of standoff measurements at a corresponding plurality of times; and (d) comprises processing the system of equations to determine (i) the lateral displacement vector of the tool at each of the plurality of times and (ii) the unknown borehole parameter vector.

18. The method of claim 16, wherein the tool includes at least three acoustic standoff sensors deployed at substantially the same longitudinal position on the tool.

19. A method for determining a parameter vector of a borehole using a plurality of standoff sensor measurements, the method comprising:

(a) rotating a downhole measurement tool in a borehole, the tool including a plurality of standoff sensors and an azimuth sensor deployed on a tool body;

(b) causing the standoff sensors to operate in sequence to acquire a first set of standoff measurements;

(c) causing the standoff sensors to operate in sequence to acquire a second set of standoff measurements;

(d) causing the azimuth sensor to acquire at least one azimuth measurement of the tool corresponding to each of the sets of standoff measurements made in (b) and (c);

(e) processing a system of equations to determine the parameter vector of the borehole, the system of equations including variables representative of (i) the parameter vector of the borehole, (ii) the first and second sets of standoff measurements, (iii) an unknown lateral tool displacement vector of the tool in the borehole corresponding to each of the first and second sets, and (iv) the azimuth measurements, and (f) performing at least one step selected from the group consisting of (i) storing the parameter vector to downhhole or surface memmory, (ii) transmitting the parameter vector to the surface, and (iii) displaying the parameter vector to an operator.

20. The method of claim 19, wherein (d) comprises causing the azimuth sensor to acquire azimuth measurements corresponding to each of said sequential standoff measurements in each of the first and second sets.

21. The method of claim 19, wherein the tool includes at least three acoustic standoff sensors deployed at substantially the same longitudinal position on the tool.

22. The method of claim 19, wherein the system of equations in (e) comprises:

$$d_k+s'_{jk}\exp(i\phi_{jk})-c_{jk}=0$$

wherein i represents a square root of the integer −1; $d_k$ represent lateral displacement vectors between a borehole coordinate system and a tool coordinate system at each of the times k; $\phi_{jk}$ represent tool azimuths for each of the standoff sensors j at each of the times k; and $s'_{jk}$ and $c_{jk}$ represent standoff vectors and borehole vectors, respectively, for each of the standoff sensors j at each of the times k.

23. The method of claim 19, wherein (e) further comprises processing the system of equations to determine the unknown lateral tool displacement vectors at each of the first and second times.

24. A method for determining a parameter vector of a borehole using a plurality of standoff sensor measurements, the method comprising:

(a) providing a downhole measurement tool in a borehole, the tool including a plurality of standoff sensors and an azimuth sensor deployed on a tool body;

(b) causing the standoff sensors to acquire a plurality of sets of standoff measurements at a corresponding plurality of times;

(c) causing the azimuth sensor to acquire at least one azimuth measurement at each of the plurality of times;

(d) processing a system of equations to determine the parameter vector of the borehole, the system of equations being selected from the group consisting of:

$$d_k+s'_{jk}\exp(i\phi_k)-c_{jk}-0;\text{ and}$$

$$d_k+s'_{jk}\exp(i\phi_k)=(a\cos(2\pi\tau_{jk})+ib\sin(2\pi\tau_{jk})\exp(i\Omega)$$

wherein i represents a square root of the integer −1; $d_k$ represent lateral displacement veelors at each of the times k; $\phi_k$ represent azimuth measurements at each of the times k; and $s'_{jk}$ and $c_{jk}$ represent standoff vectors and borehole vectors, respectively, for each of the standoff sensors j at each of the times k, a and b represent major and minor axes of said elliptical borehole; Ω represents an angular orientation of said elliptical borehole; and $\tau_{jk}$ represent auxiliary variables; and (e) performing at least one step selected from the group consisting of: (i) storing the parameter vector to downhole or surface memory, (ii) transmitting the parameter vector to the surface, and (iii) displaying the parameter vector to an operator.

25. The method of claim 24, wherein the tool includes at least three acoustic standoff sensors deployed at substantially the same longitudinal position on the tool.

26. The method of claim 24, wherein:

(b) comprises causing the plurality of standoff sensors to acquire at least three sets of standoff measurements; and (c) comprises causing the azimuth sensor to acquire at least three azimuth measurements.

27. The method of claim 24, wherein (d) further comprises processing the system of equations to determine the unknown lateral tool displacement vectors at each of the plurality of times.

28. A system for determining a parameter vector of a borehole using a plurality of standoff measurements, the system comprising:

a downhole tool including a plurality of standoff sensors, the downhole tool operable to be coupled to a drill string and rotated in a borehole; and a controller configured to:

(A) cause the standoff sensors to acquire a plurality of sets of standoff measurements at a corresponding plarality of times, the standoff measurements in each of the sets acquired sequentially;

(B) cause the azimuth sensor to acquire azimuth measurements at each of the plurality of times;

(C) process a system of equations to determine the parameter vector of the borehole, the system of equations including variables representative of (i) the parameter vector of the borehole, (ii) the plurality of sets of standoff measurements, (iii) the azimuth measurements, and (iv) an unknown lateral tool displacement vector of the tool in the borehole at each of the plurality of times; and (D) perform at least one step selected from the group consisting of: (ii storing the parameter vector to downhole or surface memory, (ii) transmitting the parameter vector to the surface, and (iii) displaying the parameter vector to an operator.

29. The system of claim 28, wherein (B) comprises causing the azimuth sensor to acquire azimuth measurements corresponding to each of the standoff measurements in each of the sets.

30. A computer readable medium storing a software program, the software program configured to enable a processor to perform a method for determining a parameter vector of a borehole using a plurality of sets of standoff measurements, the method comprising:

(a) causing a plurality of standoff sensors deployed on a downhole tool to acquire a plurality of sets of standoff measurements at a corresponding plurality of times;

(b) processing a system of equations to determine the parameter vector of the borehole, the system of equations being selected from the group consisting of:

$$d_k+s'_{jk}\exp(i\phi_k)-c_{jk}=0;\text{ and}$$

$$d_k+s'_{jk}\exp(i\phi_k)=(a\cos(2\pi\tau_{jk})+ib\sin(2\pi\tau_{jk})\exp(i\Omega)$$

wherein i represents a square root of the integer −1; $d_k$ represent lateral displacement vectors at each of the times k; $\phi_k$ represent azimuth measurements at each of the times k; and $s'_{jk}$ and $c_{jk}$ represent standoff vectors and borehole vectors, respectively, for each of the standoff sensors j at each of the times k, a and b represent major and minor axes of said elliptical borehole; Ω represents an angular orientation of said elliptical borehole; and $\tau_{jk}$ represent auxilliary variables; and (c) performing at least one step selectcd from the group consisting of: (i) storing the parameter vector to downhole or surface memory, (ii) transmitting the parameter vector to the surface, and (iii) displaying the parameter vector to an operator.

31. A computer readable medium storing a software program, the software program configured to enable a processor to perform a method for determining a lateral displacement vector of a dowuhole tool in a borehole using a plurality of sets of standoff measurements the method comprising:

(a) causing a plurality of standoff sensors deployed on the tool to acquire a plurality of standoff measurements; and (b) processing a system of equations to determine the lateral displacement vector of the tool in the borehole, the system of equations including:

$$d_k+s'_{jk}\exp(i\phi_{jk})c_{jk}=0$$

wherein i represents a square root of the integer 1: $d_k$ represent lateral displacement vectors between a borehole coordinate system and a tool coordinate system at each of the times k; $\phi_{jk}$ represent tool azimuths for each of the standoff sensors j at each of the times k; and $s'_{jk}$ and $c_{jk}$ represent standoff vectors and borehole vectors, respectively, for each of the standoff sensors j at each of the times k; and (c) performing at least one step selected from the group consisting of: (i) storing the lateral displacement vector to dowohole or surface memory, (ii) transmitting the lateral displacement vector to the surface, and (iii) displaying the lateral displacement vector to an operator.

* * * * *

UNITED STATES PATENT AND TRADEMARK OFFICE

CERTIFICATE OF CORRECTION

PATENT NO. : 7,260,477 B2
APPLICATION NO. : 10/871205
DATED : August 21, 2007
INVENTOR(S) : Samuel Mark Haugland It is certified that error appears in the above-identified patent and that said Letters Patent is hereby corrected as shown below:

column 16, line 44, --and an azimuth sensor-- should be inserted after sensors and before the comma Signed and Sealed this Twentieth Day of April, 2010

David J. Kappos

David J. Kappos
*Director of the United States Patent and Trademark Office*